US012279684B1

(12) United States Patent
Huang et al.

(10) Patent No.: US 12,279,684 B1
(45) Date of Patent: Apr. 22, 2025

(54) NAIL POLISHER WITH UV LAMP

(71) Applicant: Shenzhen Zhihui Youpin Technology Co., LTD, Shenzhen (CN)

(72) Inventors: Wenyan Huang, Shenzhen (CN); Yadan Bu, Shenzhen (CN); Xianwei Liu, Shenzhen (CN)

( * ) Notice: Subject to any disclaimer, the term of this patent is extended or adjusted under 35 U.S.C. 154(b) by 0 days.

(21) Appl. No.: 18/411,910

(22) Filed: Jan. 12, 2024

(51) Int. Cl.
*A45D 29/14* (2006.01)

(52) U.S. Cl.
CPC ..... *A45D 29/14* (2013.01); *A45D 2200/205* (2013.01)

(58) Field of Classification Search
CPC ..... B24B 19/26
See application file for complete search history.

(56) References Cited

U.S. PATENT DOCUMENTS

2021/0100332 A1* 4/2021 Hsieh ..... A61L 2/10
2022/0128841 A1* 4/2022 Jung ..... H04R 1/105
2023/0134504 A1* 5/2023 Haile ..... A45D 29/05 132/73.6

FOREIGN PATENT DOCUMENTS

CN 114711531 * 7/2022
CN 219982335 * 11/2023
DE 19619778 * 12/1996

* cited by examiner

*Primary Examiner* — Nicholas D Lucchesi
*Assistant Examiner* — Jennifer Gill
(74) *Attorney, Agent, or Firm* — Daniel M. Cohn; Howard M. Cohn

(57) ABSTRACT

A nail polisher with UV lamp, comprising: a shell; a nail polishing assembly; a motor; a UV lamp assembly; a PCB board; a power supply assembly; the shell is provided with an accommodation cavity, and both ends of the shell are respectively provided with a first through hole and a second through hole communicating with the accommodation cavity; the nail polishing assembly comprises a transmission mechanism installed in the accommodation cavity. With the connection and cooperation between the motor output end and the transmission mechanism, the motor can drive the transmission mechanism to rotate, and then drive the polishing head to rotate, thereby polishing the nails. As for the UV lamp assembly, it is disposed in the accommodation cavity and close to the second through hole for curing the nail polish. It can avoid damaging the back of the hand and only treat the nails, which improves safety.

4 Claims, 5 Drawing Sheets

NAIL POLISHER WITH UV LAMP

TECHNICAL FIELD

The present disclosure relates to a technical field of nail polishers, and in particular to a nail polisher with UV lamp.

BACKGROUND

The nail polisher is a product used to polish nails. The nail polisher drives the transmission shaft to rotate through the rotation of the motor, thereby driving the rotor to rotate. The sandpaper and other materials attached to the turner remove dirt and grease from the nail surface, making the nail surface smooth and adhesion strengthened. Traditional nail polishers use mechanical gear changes to adjust the speed.

In the existing technology, the traditional nail polisher only supports the polishing of nails. However, in actual use, the nail polisher is used to polish nails for manicure. To do manicure, you need UV lamp for drying. Traditional nail polisher requires additional purchase of UV lamp for use, which is difficult to meet the actual needs of users. Secondly, due to its large area, traditional manicure lamps also bake the skin other than the nails at the same time, which can easily cause surface damage to the skin on the back of the hand. Therefore, avoiding damage to the skin on the back of the hands and being able to complete the entire manicure process with one product have become technical issues that need to be solved urgently.

SUMMARY

In order to solve a technical problem that a single device being unable to complete the manicure process alone, increasing costs, and causing damage to the skin on the back of the hands; the present disclosure provides the nail polisher with UV lamp, comprising: a shell; a nail polishing assembly; a motor; a UV lamp assembly; a PCB board; a power supply assembly; wherein the shell is provided with an accommodation cavity, and both ends of the shell are respectively provided with a first through hole and a second through hole communicating with the accommodation cavity; the nail polishing assembly comprises a transmission mechanism installed in the accommodation cavity, and a polishing head that penetrates the first through hole and is detachably connected to the output end of the transmission mechanism; the motor is installed in the accommodation cavity, the output end of the motor is connected to the transmission mechanism, and the motor is used to drive the transmission mechanism to rotate; the UV lamp assembly is provided in the accommodation cavity and close to the second through hole for curing nail polish; the PCB board is arranged in the accommodation cavity and is electrically connected to the motor; the power supply assembly is provided on the side of the PCB board for supplying energy to the internal structure of the shell.

Furthermore, the nail polisher also comprises a stepless speed control component, and the stepless speed control component comprises a potentiometer; the potentiometer is arranged on the side of the PCB board and is in close contact with the PCB board; a roller is rotatably connected to the power output shaft of the potentiometer, part of the rollers penetrates the shell and is arranged outside the shell.

Furthermore, the transmission mechanism comprises a main shaft, and the outside of the main shaft is engaged with the inner wall of the shell; the main shaft has a cavity connected inside and outside, and a rotating shaft body is installed in the cavity.

Furthermore, the rotating shaft body comprises a first rotating shaft, a second rotating shaft and a third rotating shaft, one end of the first rotating shaft is connected to the output end of the motor, and the other end is recessed with a first jack along its inner direction, the first jack is plugged into one end of the second rotating shaft; the other end of the second rotating shaft is recessed with a second jack along its inner direction; one end of the third rotating shaft is plugged into the second jack, and the other end penetrates the cavity and is located on the top of the main shaft.

Furthermore, the outside of the insertion joints of the second rotating shaft and the third rotating shaft are equipped with buffer springs.

Furthermore, a plurality of collars is sleeved on the outside of the third rotating shaft located in the cavity, the outer portions of the plurality of collars are engaged with the inner wall surface of the main shaft.

Furthermore, the UV lamp assembly comprises a TYPE-C board, a UV curing lamp and a tail cover; one side of the UV curing lamp is disposed on the side of the TYPE-C board, and the other side faces the direction of the second through hole; the tail cover is installed on the second through hole.

Furthermore, the shell comprises an upper shell, a lower shell, a pen tip shell and a decorative ring; the upper shell and the lower shell are snapped together to form a half shell; the half shell has an open end; the pen tip shell is sealed and assembled with the open end through the decorative ring.

Furthermore, the end of the half shell is the second through hole, and the end of the pen tip shell is the first through hole.

Furthermore, the outside of the half shell is provided with a UV lamp switch, a nail polishing switch and a USB socket.

The nail polisher with UV lamp provided by the present disclosure has beneficial effects as follows.

The shell is provided with the accommodation cavity, and the transmission mechanism and the polishing head detachably connected to the output end of the transmission mechanism are installed in the accommodation cavity. With the connection and cooperation between the motor output end and the transmission mechanism, the motor can drive the transmission mechanism to rotate, and then drive the polishing head to rotate, thereby polishing the nails. Secondly, there is a UV lamp assembly installed in the accommodation cavity, which can only cure the nail polish on the nails without damaging other skin on the back of the hand. The above design saves costs. There is no need for multiple devices to complete the manicure process. Only one device is needed to polish nails and cure nail polish. At the same time, safety is also guaranteed and improved.

BRIEF DESCRIPTION OF DRAWINGS

In order to more clearly illustrate technical solutions in embodiments of the present disclosure, drawings required in description or prior art are briefly introduced below, and obviously, the drawings in the following description are merely some embodiments of the present disclosure. For a person having ordinary skill in art, other drawings may be obtained of the drawings without creative efforts.

Figure 1:
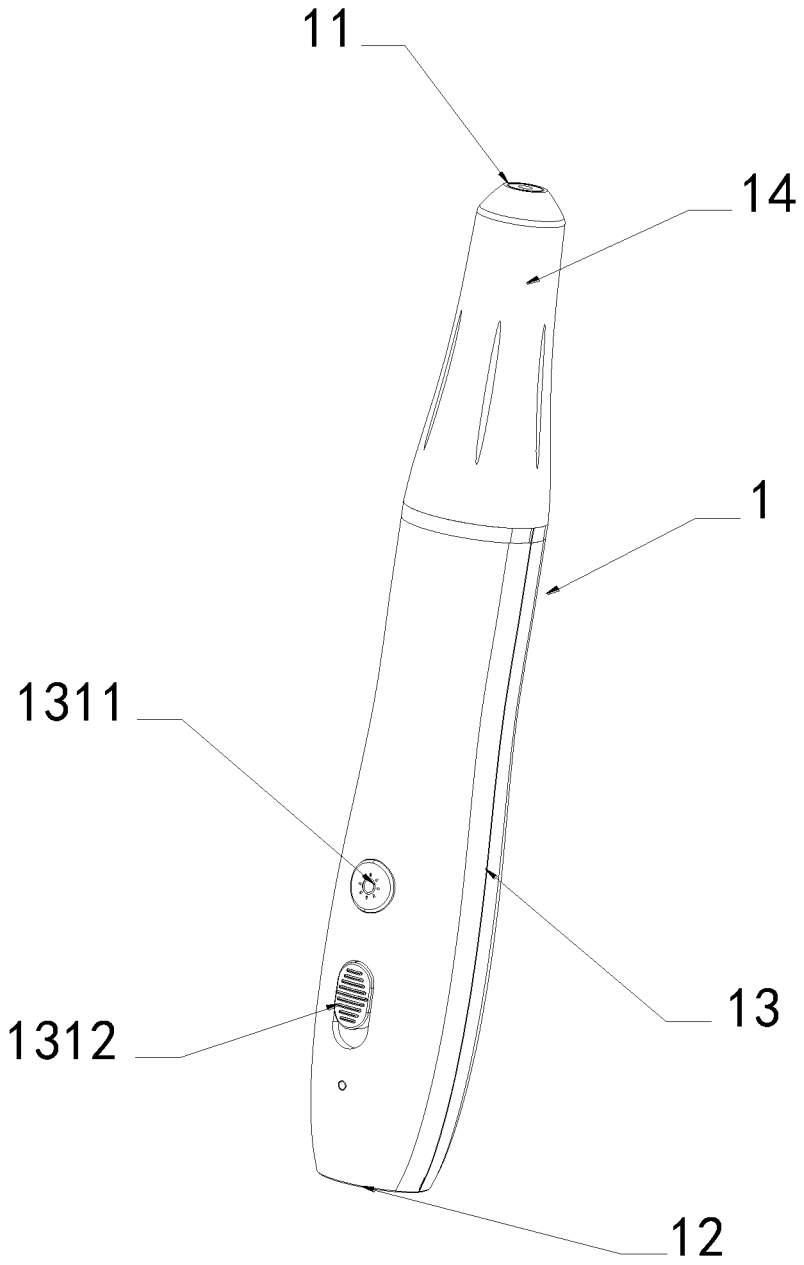
FIG. 1 is a schematic three-dimensional structural diagram of a nail polisher with UV lamp of the present disclosure.

Reference number in the figures:

| | | | |
|---|---|---|---|
| shell | 1 | first through hole | 11 |
| second through hole | 12 | half shell | 13 |
| upper shell | 131 | UV lamp switch | 1311 |
| nail polishing switch | 1312 | lower shell | 132 |
| pen tip shell | 14 | decorative ring | 15 |
| transmission mechanism | 2 | main shaft | 21 |
| rotating shaft body | 22 | first rotating shaft | 221 |
| second rotating shaft | 222 | third rotating shaft | 223 |
| buffer springs | 23 | collars | 24 |
| motor | 3 | UV lamp assembly | 4 |
| TYPE-C board | 41 | UV curing lamp | 42 |
| tail cover | 43 | PCB board | 5 |
| power supply assembly | 6 | stepless speed control component | 7 |
| roller | 71 | | |

DETAILED DESCRIPTION

In order to make objectives, technical solutions, and advantages of the present disclosure clearer, the present disclosure is further described in details below with reference to accompanying drawings and embodiments. It should be understood that the specific embodiments described herein are merely used to explain the present disclosure, and are not intended to limit the present disclosure.

It should be noted that when an element is referred to as being "fixed to" or "disposed on" another element, the element may be directly on the other element or the element may be indirectly fixed to or disposed on the other element by means of a third component. When an element is referred to as being "connected to" another element, the element may be directly connected to the other element or the element may be indirectly connected to the other element by means of a third component.

In addition, the terms "first" and "second" are used for descriptive purposes only and cannot be understood as indicating or implying relative importance or implicitly indicating a number of indicated technical features. Thus, features defined with "first" and "second" may explicitly or implicitly include one or more of the features. In description of the present disclosure, "a plurality of" means two or more, unless specifically defined otherwise.

The present disclosure provides a nail polisher with UV lamp, which is used in nail art technology. Referring to FIG. 1 to FIG. 5, the nail polisher with UV lamp, comprising: a shell 1; a nail polishing assembly; a motor 3; a UV lamp assembly 4; a PCB board 5; a power supply assembly 6 and other components that meet the normal operation of the structure, such as wires, etc. The shell 1 is provided with an accommodation cavity, and both ends of the shell 1 are respectively provided with a first through hole 11 and a second through hole 12 communicating with the accommodation cavity; the nail polishing assembly comprises a transmission mechanism 2 installed in the accommodation cavity, and a polishing head that penetrates the first through hole 11 and is detachably connected to the output end of the transmission mechanism 2; and the motor 3 is installed in the accommodation cavity, and the PCB board 5 is electrically connected to the motor 3 in the accommodation cavity to control the output power of the motor 3. And because the output end of the motor 3 is connected to the transmission mechanism 2, it can drive the transmission mechanism 2 to rotate, and then drive the polishing head (not shown) to rotate, so as to polish the nails. As for the UV lamp assembly 4, it is disposed in the accommodation cavity and close to the second through hole 12 for curing the nail polish applied on the nails. It can avoid damaging the back of the hand and only treat the nails, which greatly improves safety. Secondly, the functions of nail polishing and nail polish curing are realized in one device, which greatly saves costs and can also save manicure time, that is, the nail polish is quickly dried and efficiency is improved.

Figure 3:
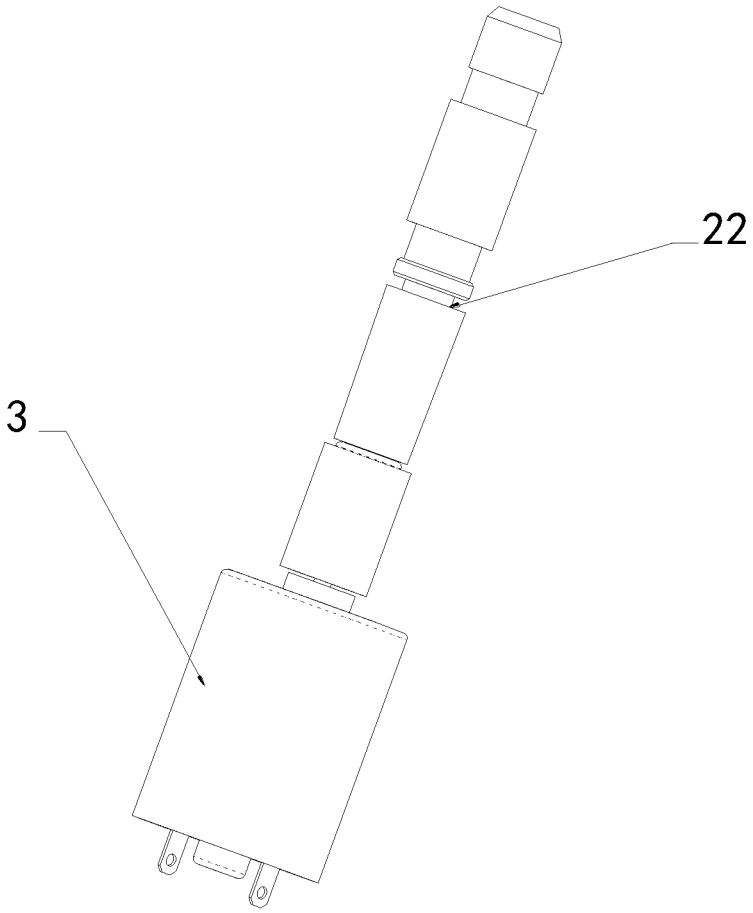
FIG. 3 is a schematic structural diagram of the main shaft of the present disclosure (including the motor).
Figure 5:
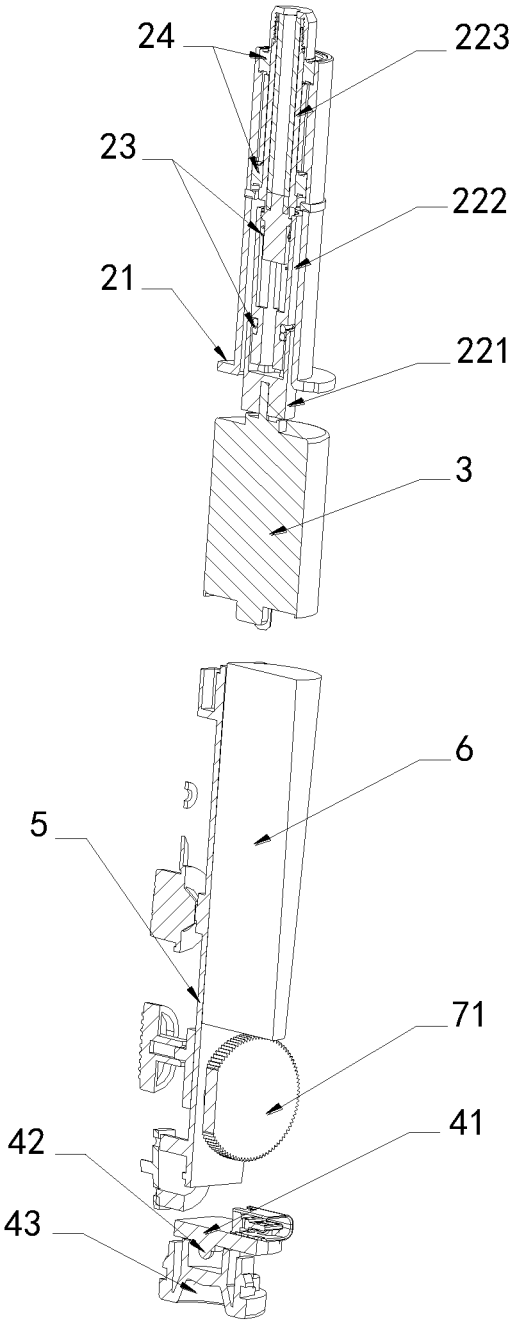
FIG. 5 is an exploded schematic diagram of the nail polisher with UV lamp shown in FIG. 4 excluding the shell according to the present disclosure.

In the present embodiment, referring to FIG. 3 and FIG. 5, the nail polisher also comprises a stepless speed control component 7, and the stepless speed control component 7 comprises a potentiometer; the potentiometer is arranged on the side of the PCB board 5 and is in close contact with the PCB board 5; a roller 71 is rotatably connected to the power output shaft of the potentiometer, part of the rollers 71 penetrates the shell 1 and is arranged outside the shell 1. By rotating the roller 71, it drives the potentiometer to rotate, thereby controlling the output voltage of the PCB board 5, thereby adjusting the rotational speed of the transmission mechanism 2, thereby adjusting the rotational speed of the polishing head.

In the embodiment, it should be noted that the surface of the polishing head is provided with sandpaper for sanding the nail surface, and secondly, the polishing head is plugged into the transmission mechanism 2. This design facilitates the replacement of polishing heads of different sizes. Of course, in other embodiments, the end of the polishing head can also be clamped on the transmission mechanism 2. Obviously, it only needs to satisfy the requirements that the polishing head does not break away from the transmission mechanism 2 when rotating and it is convenient to replace it.

Figure 4:
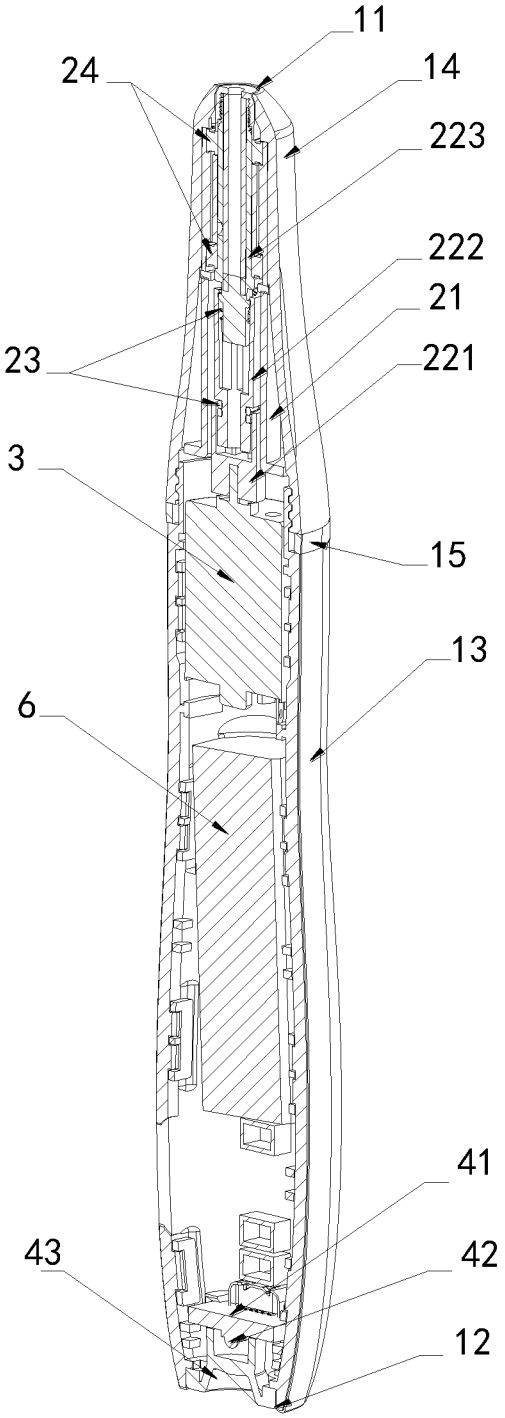
FIG. 4 is a cross-sectional diagram of the present disclosure.

Specifically, the transmission mechanism 2 is further described. Referring to FIG. 1, FIG. 3 and FIG. 4, the transmission mechanism 2 comprises a main shaft 21, and the outside of the main shaft 21 is engaged with the inner wall of the shell 1. This setting is used to stabilize the position of the main shaft 21. The main shaft 21 has a cavity connected inside and outside, and a rotating shaft body 22 is installed in the cavity. The above settings are mainly to ensure that the rotating shaft 22 can rotate stably and not deviate from the predetermined position.

The rotating shaft body 22 comprises a first rotating shaft 221, a second rotating shaft 222 and a third rotating shaft 223, one end of the first rotating shaft 221 is connected to the output end of the motor 3, and the other end is recessed with a first jack along its inner direction, the first jack is plugged into one end of the second rotating shaft 222; the other end of the second rotating shaft 222 is recessed with a second jack along its inner direction; one end of the third rotating shaft 223 is plugged into the second jack, and the other end penetrates the cavity and is located on the top of the main shaft 21. Obviously, the first rotating shaft 221, the second rotating shaft 222 and the third rotating shaft 223 are driven by the motor 3 to rotate synchronously.

Furthermore, in order to ensure the stability of the rotation of the first rotating shaft 221, the second rotating shaft 222 and the third rotating shaft 223, the outside of the insertion joints of the second rotating shaft 222 and the third rotating shaft 223 are equipped with buffer springs 23 to reduce the impact of vibration. Secondly, in order to further ensure the stability of the rotation of the third rotating shaft 223, the end of the third rotating shaft 223 located at the first through hole 11 is plugged and fixed with the polishing head. A plurality of collars 24 are sleeved on the outside of the third rotating shaft 223 located in the cavity, the outer portions of the plurality of collars 24 are engaged with the inner wall surface of the main shaft 21, thereby allowing the third rotating shaft 223 to rotate along a predetermined route in a stable environment.

In the embodiment, referring to FIG. 3, furthermore, the number of collars 24 is two, and the two collars 24 are respectively located outside the third rotating shaft 223 near both ends. In fact, in other embodiments, the number of collars 24 can be three, four, etc., as long as the third rotating shaft 223 can be ensured to rotate on a predetermined route and its stable rotation speed can be ensured.

Figure 2:
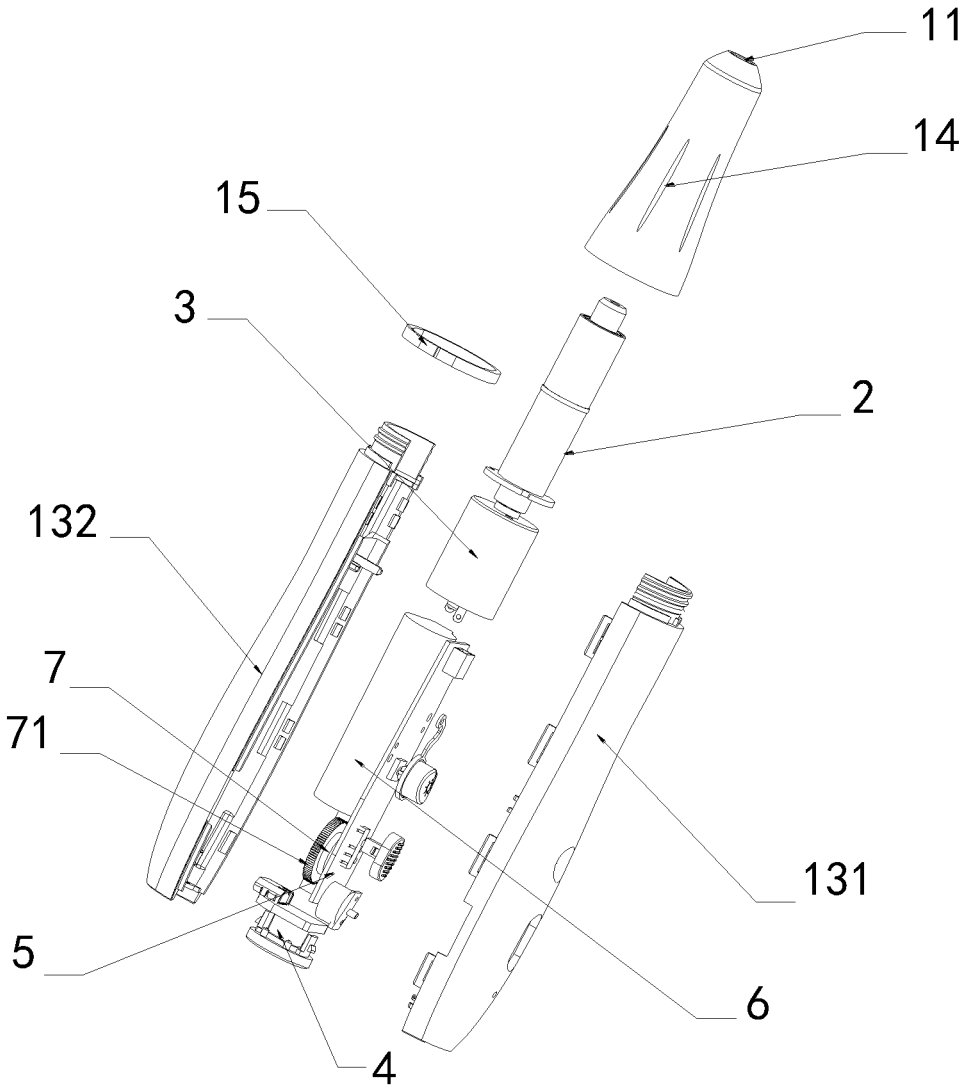
FIG. 2 is an explosion schematic diagram of the present disclosure taken alone a longitudinal axis of the nail polisher with UV lamp shown in FIG. 1.

In the embodiment, referring to FIG. 2 to FIG. 4, furthermore, the UV lamp assembly 4 comprises a TYPE-C board 41, a UV curing lamp 42, a tail cover 43 and assembly that meet the normal operation of the UV lamp assembly 4; the TYPE-C board 41 is mainly the interface for the current input of the power supply assembly 6; one side of the UV curing lamp 42 is disposed on the side of the TYPE-C board 41, and the other side faces the direction of the second through hole 12; the tail cover 43 is installed on the second through hole 12. It should be noted that the tail cover 43 can transmit the light emitted by the UV curing lamp 42, thereby curing the nail polish on the nails.

Furthermore, further elaboration will be given on the shell 1 wrapping the above structure. Referring to FIG. 1 and FIG. 2, the shell 1 comprises an upper shell 131, a lower shell 132, a pen tip shell 14 and a decorative ring 15; the upper shell 131 and the lower shell 132 are snapped together to form a half shell 13; the half shell 13 has an open end; the pen tip shell 14 is sealed and assembled with the open end through the decorative ring 15, thereby forming the accommodation cavity. It should be noted that the end of the shell 1 is the second through hole 12, the end of the pen tip shell 14 is the first through hole 11, and the outside of the pen tip shell 14 is in the shape of a truncated cone. The inner diameter of one end of the pen tip shell 14 with the first through hole 11 is smaller than the inner diameter of the other end of the pen tip shell 14. This design facilitates nail polishing, that is, it facilitates the operator to control the process of operating the nail polisher on the nails.

In essence, please refer to FIG. 1, FIG. 2 and FIG. 4, the outside of the half shell 13 is provided with a UV lamp switch 1311, a nail polishing switch 1312 and a USB socket. The UV lamp switch 1311 is used to turn on or off the UV curing lamp 42. As for the nail polishing switch 1312, a toggle switch is used to control the forward or reverse rotation of the main shaft 21. Pushing the nail polishing switch 1312 along the direction of the first through hole 11 causes the main shaft 21 to rotate forward, pushing along the direction of the second through hole 12 causes the main shaft 21 to rotate reversely, and when it is in the middle, it is in a closed state. Then the USB socket is used to charge the internal power supply assembly 6 externally.

In the present embodiment, referring to FIG. 1 and FIG. 5, furthermore, the power supply assembly 6 is disposed on the side of the PCB board 5 for supplying energy to the internal structure of the shell 1. The power supply assembly 6 includes a battery module.

A further description of the working principle of the nail polisher: first, the battery module supplies energy to the internal structure of the nail polisher. When work is required, the operator pushes the nail polishing switch 1312. The motor 3 drives the rotating shaft 22 to rotate, causing the polishing head connected with it to rotate accordingly to polish the nails. Secondly, when you want to adjust the rotation speed of the grinding head, you can adjust the stepless speed control component 7, that is, rotate the roller 71 that is rotated to drive the rotation of the potentiometer to control the output voltage of the PCB board 5, adjust the power of the motor 3, and then adjust the rotation speed of the rotating shaft 22 in the transmission mechanism 2. Thereby adjusting the rotation speed of the polishing head, polishing the nails in an optimal way to make the nail surface smooth and strengthen the adhesion. After applying nail polish to the nails, the nail polish needs to be dried, that is, the nail polish is cured. At this time, turn on the UV lamp switch 1311, and the UV curing lamp 42 will emit purple light to bake the nails in a small range, thereby quickly drying the nail polish. This design has a small baking range, and the UV curing lamp 42 focuses on the nail cap to avoid damage to the skin on the back of the hand, which greatly facilitates customers' manicure needs.

Above are only preferred embodiments of the present disclosure and are not intended to limit the present disclosure. Any modification, equivalent replacement and improvement made within spirit and principle of the present disclosure should be included in protection scope of the present disclosure.

What is claimed is:

1. A nail grinder with a UV lamp assembly, comprising:

a shell; a nail grinding assembly; a motor; the UV lamp assembly; a PCB board; a power supply assembly;

wherein the shell is provided with an accommodation cavity, and both ends of the shell are respectively provided with a first through hole and a second through hole communicating with the accommodation cavity;

the nail grinding assembly comprises a transmission mechanism installed in the accommodation cavity, and a polishing head that penetrates the first through hole and is detachably connected to the output end of the transmission mechanism;

the motor is installed in the accommodation cavity, the output end of the motor is connected to the transmission mechanism, and the motor is used to drive the transmission mechanism to rotate;

the UV lamp assembly is provided in the accommodation cavity and close to the second through hole for curing nail polish;

the PCB board is arranged in the accommodation cavity and is electrically connected to the motor;

the power supply assembly is disposed on a side of the PCB board for supplying energy to the motor, the UV lamp assembly, and the PCB board that are disposed inside the shell;

wherein the transmission mechanism comprises a main shaft, wherein an outside of the main shaft is engaged with an inner wall of the shell; wherein the main shaft has a cavity, and wherein a rotating shaft body is installed in the cavity in the main shaft;

wherein the rotating shaft body comprises a first rotating shaft, a second rotating shaft, and a third rotating shaft, wherein one end of the first rotating shaft is fixedly connected to an output end of the motor, the output end of the motor being an output shaft of the motor, and wherein another end of the first rotating shaft defines a first jack recessed towards an inside of the first rotating shaft; wherein one end of the second rotating shaft is inserted into and fixedly fitted with the first jack, and another end of the second rotating shaft defines a second jack recessed towards an inside of the second rotating shaft; wherein one end of the third rotating shaft is inserted into and fixedly fitted with the second jack, and wherein another end of the third rotating shaft penetrates the cavity and is disposed on a top of the main shaft, wherein a plurality of collars is sleeved on an outside of the third rotating shaft located in the cavity, and wherein outer portions of the plurality of collars are engaged with an inner wall surface of the main shaft; wherein the first rotating shaft, the second rotating shaft, and the third rotating shaft are each have a substantially linear shape, and are substantially collinearly and coaxially arranged on a straight line; wherein the motor is operative to drive motor output end to rotate and further drive the rotating shaft body to rotate, wherein the first rotating shaft, the second rotating shaft, and the third rotating shaft are operative to be driven to rotate;

wherein there is disposed a buffer spring at an insertion joint between the second rotating shaft and the third rotating shaft at which the end of the third rotating shaft is inserted into and fitted with the second jack defined in the second rotating shaft, the buffer spring being used to reduce an impact of vibration between the second rotating shaft and the third rotating shaft;

wherein the nail grinder further comprises a stepless speed control component, wherein the stepless control component comprises a potentiometer; the potentiometer is arranged on a side of the PCB board and is in close contact with the PCB board; wherein there is arranged a roller that is rotatably connected to the power output shaft of the potentiometer, and wherein a part of the roller penetrates the shell and is arranged outside the shell.

2. The nail grinder of claim 1, wherein the shell comprises an upper shell, a lower shell, a pen tip shell and a decorative ring; the upper shell and the lower shell are snapped together to form a half shell; the half shell has an open end; the pen tip shell is sealed and assembled with the open end through the decorative ring.

3. The nail grinder of claim 2, wherein an end of the half shell facing away from the pen tip shell is the second through hole, and an end of the pen tip shell facing away from the half shell is the first through hole.

4. The nail grinder of claim 3, wherein the outside of the half shell is provided with a UV lamp switch, a nail grinder switch and a USB socket, wherein the UV lamp switch is electrically connected to the UV lamp assembly and configured to turn on or off the UV lamp assembly; wherein the nail grinder switch is electrically connected to the nail grinder and configured to turn on or off the nail grinder, and wherein the USB socket is connected to the PCB board.

* * * * *